US006752200B2

(12) United States Patent
Holub

(10) Patent No.: US 6,752,200 B2
(45) Date of Patent: Jun. 22, 2004

(54) TRANSMISSION OIL COOLER AND FILTER

(75) Inventor: Patrick Kevin Holub, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 36 days.

(21) Appl. No.: 10/064,224

(22) Filed: Jun. 21, 2002

(65) Prior Publication Data

US 2003/0234097 A1 Dec. 25, 2003

(51) Int. Cl.[7] ..... F01P 3/00; F28F 19/00
(52) U.S. Cl. ..... 165/41; 165/51; 165/119
(58) Field of Search ..... 165/41, 51, 119, 165/67, 905

(56) References Cited

U.S. PATENT DOCUMENTS 4,638,856 A * 1/1987 Yamanaka et al.
4,878,536 A * 11/1989 Stenlund ..... 165/51 X
5,537,839 A 7/1996 Burk et al.
5,975,245 A * 11/1999 Jephott et al.
6,446,714 B1 * 9/2002 Kaspar et al. ..... 165/41 X

* cited by examiner

*Primary Examiner*—L V Ciric
(74) *Attorney, Agent, or Firm*—David B. Kelley

(57) ABSTRACT

An oil cooler for a vehicle with an automatic transmission that includes a core contained between two end pipes. A first one of the end pipes includes an oil inlet, for directing oil from the transmission, and an oil outlet, directing oil back to the transmission, and a dividing plate having a flow control orifice. An oil filter is positioned around the flow control orifice to filter the oil flowing through the orifice, thereby removing contaminants from the oil, while the oil flowing through the core is cooled.

13 Claims, 2 Drawing Sheets

TRANSMISSION OIL COOLER AND FILTER

BACKGROUND OF INVENTION

The present invention relates to transmission oil circuits, and more particularly to an oil filter for the transmission oil.

In order to satisfy operators of automotive vehicles, transmission shift quality and performance for automatic transmissions has improved in recent years. Also, vehicle owners expect the vehicles to last longer, which means that the automatic transmissions' working life requirements have increased. In order to meet these demands, the use of more sensitive electronic solenoids has been required. But these solenoids are much more sensitive to small contaminants in the transmission oil, which can build up to a greater extent over the longer life of the vehicle. Since on previous automatic transmissions, the very small contaminants were not considered a problem, only a coarse media filter was employed on the suction side of the transmission oil circuit just prior to an oil pump. However, this type of filter is proving inadequate at removing the fine particles that can begin to interfere with the operation of the more sensitive solenoids, and may degrade the long term durability of the transmission due to contaminant related wear and valve silting.

To overcome the filtration concern, it is recognized that the addition of a high-efficiency, pressure-side filter will reduce the fine contaminants and hence improve the performance and durability of the automatic transmission. But high efficiency filters can add undesirable pressure drops, thus requiring some type of bypass flow arrangement. This is needed in order to avoid increasing the pump flow demand, and to assure protection for the oil circuit flow during cold starts of the engine or following filter blind off. Also, for efficient filtration, a consistent, stable oil flow is desired. Furthermore, it is desirable that this filter is easily accessible for servicing, if required.

One way to filter the oil in order to avoid contaminants degrading the performance of the transmission is to add an additional oil filter to the transmission oil circuit. Since transmissions are expensive to redesign and it is preferred that a filter have easy access to replace, if needed, it is best to add the filter in the oil circuit external to the transmission. But adding an external oil filter has additional costs, such as the filter element, a filter housing with corrosion protection that will allow it to last the life of the vehicle without failing, additional hose or tubing to connect it into the transmission oil circuit, connection hardware for the new hoses, and possibly bypass valve hardware if full flow filtration is employed. In addition to the cost and complexity added to the oil circuit, the external filter adds more potential leak paths to the oil circuit, which may increase warranty costs of the vehicle.

Thus, it is desirable to have a transmission oil filter that will efficiently filter fine contaminants from transmission oil, while minimizing the costs and potential leak paths for such a filter.

SUMMARY OF INVENTION

In its embodiments, the present invention contemplates an oil cooler assembly for use with an automatic transmission system of a vehicle. The oil cooler assembly has a first end pipe and a second end pipe, with the first end pipe including an oil inlet, adapted for receiving oil from the transmission system, and an oil outlet, adapted for returning oil to the transmission system, and a dividing plate sealingly mounted in the first end pipe between the oil inlet and the oil outlet, with the dividing plate including a flow control orifice therethrough. A core is contained between the first end pipe and the second end pipe, including a first set of ribs extending therebetween adapted for allowing oil to flow from the first end pipe to the second end pipe and a second set of ribs extending therebetween adapted for allowing oil to flow from the second end pipe to the first end pipe. The oil cooler assembly also has an oil filter sealingly mounted in the first end pipe about the orifice and adapted to thereby cause oil flowing through the orifice to flow through the filter.

The invention further contemplates a method of filtering oil in an oil cooler circuit adapted for use with a vehicle automatic transmission system, with the method comprising the steps of: receiving oil in a first end pipe of an oil cooler through an inlet; flowing a first portion of the oil through a first set of ribs in an oil cooler core to a second end pipe; flowing the first portion of the oil through a second set of ribs in the oil cooler core back to the first end pipe; flowing the first portion of the oil out of the oil cooler through an outlet; flowing a remaining portion of the oil through an orifice in a dividing plate which separates the inlet from the outlet in the first end pipe; filtering the remaining portion of the oil that passes through the orifice; and flowing the remaining portion of the oil out of the oil cooler through an outlet.

An embodiment of the present invention allows a transmission oil filter to be integrated into an automatic transmission oil cooler, using the oil cooler itself as the housing for the oil filter.

An advantage of an embodiment of the present invention is that no additional housing is needed in order to add a transmission oil filter into a transmission oil circuit.

Another advantage of an embodiment of the present invention is that the cost of adding a transmission oil filter capable of filtering fine contaminants is greatly reduced.

A further advantage of an embodiment of the present invention is that a transmission oil filter capable of filtering fine contaminants is added while still minimizing the number of potential leak paths for the oil in the transmission oil circuit.

An additional advantage of an embodiment of the present invention is that the fine contaminant filter is added without significantly increasing the transmission oil pump flow demand, while also allowing for protection of oil circuit flow during cold engine starts and filter blind off conditions.

DETAILED DESCRIPTION

Figure 1:
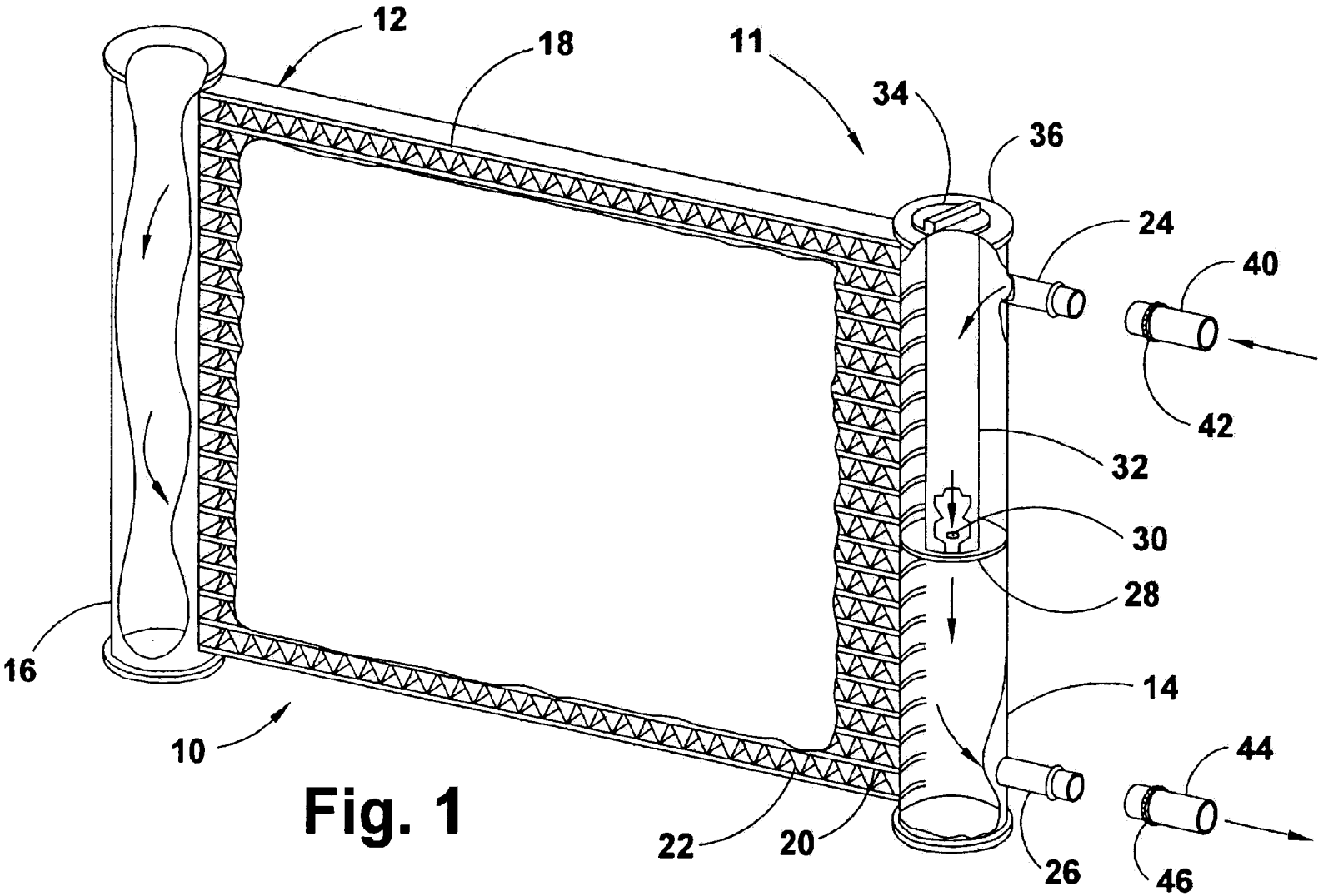
FIG. 1 is a perspective, partially exploded, partial cutaway, view of a transmission oil cooler circuit with a filter in accordance with the present invention.

FIG. 1 illustrates a portion of a transmission oil circuit 10, including a transmission oil cooler circuit 11 having a transmission oil cooler assembly 12. The transmission oil cooler assembly 12 is an air/liquid heat exchanger, with the liquid being oil from an automatic transmission (not shown) of a vehicle (not shown). The transmission oil cooler assembly 12 includes a first end pipe 14 and a second end pipe 16 (sometimes also referred to as headers). A heater core 18 extends between the two end pipes 14, 16, and includes ribs 20 (sometimes also referred to as tubes), which are mounted to carry oil between the two end pipes 14, 16, with cooling fins 22 mounted between the ribs 20.

The first end pipe 14 includes an oil cooler inlet 24 located near the upper end of the pipe 14, and an oil cooler outlet 26 located near the lower end of the pipe 14. An end pipe dividing plate 28 is mounted in the first pipe 14 and is sealed between the outer periphery of the plate 28 and the inner wall of the pipe 14. This generally creates a parallel flow, two pass heat exchanger configuration. The dividing plate 28, in the present invention, includes a flow control orifice 30 through the plate.

A cartridge filter element 32 has a first end that is sealed to the dividing plate 28, extending circumferentially around the orifice 30. The filter 32 has a second end that mounts and seals against a filter servicing cover 34 in an end cap 36 of the first pipe 14. The ends of the filter 32 can be sealed with O-rings, adhesive, or some other typical type of sealing arrangement. The filter 32 itself can be made of, for example, paper, fiberglass, a cylindrical pleated type of filter that slides through the opening that the servicing cover 34 secures to, or some other suitable filter material for oil.

An inlet hose 40 is mounted to the oil cooler inlet 24 and extends to a transmission oil outlet (not shown), with a conventional hose clamp 42 engaged around the inlet hose 40 to secure it to the inlet 24. An outlet hose 44 is mounted to the oil cooler outlet 26 and extends to a transmission oil inlet (not shown), with a conventional hose clamp 46 engaged around the outlet hose 44 to secure it to the outlet 26. The transmission oil cooler assembly 11 is mounted in the vehicle in such a way that air will flow through the fins 22 in the core 18, whether the air flow is created by a fan (not shown) or by the movement of the vehicle.

The operation of the transmission oil cooler assembly 12 will now be described. As the vehicle is driven, a conventional oil pump (not shown) causes the oil to flow through various portions of the transmission, The oil reaching the transmission outlet that is connected to the inlet hose 40 will flow through the hose 40 and the oil cooler inlet 24, and into the upper portion of the first end pipe 14. The arrows in FIGS. 1 and 2 indicated the general direction of flaw of the oil through the transmission oil cooler circuit 11. Most of the oil will then flow through the upper half of the ribs 20 to the second pipe 16, being cooled as the air pulls heat from the fins 22. This oil will then flow back through the lower half of the ribs 20 and into the lower half of the first end pipe 14, again being cooled as it flows through the ribs 20. Also, a portion of the oil entering the oil cooler inlet 24 will instead flow through the filter 32 thus trapping contaminants in the filter material down through the orifice 30 in the dividing plate 28, and into the lower half of the first end pipe 14. The small size of the orifice 30 will limit the oil flow through the filter to only a relatively small percentage of the oil. The oil in the lower half of the first end pipe 14 will then flow through the oil cooler outlet 26, through the outlet hose 44 and back to the transmission.

The particular size of the orifice 30 is a matter of design choice, depending upon the percentage of oil one desires to have filtered versus the percentage of oil to be cooled. To determine the percentage of desired oil flow through the filter 32 versus through the oil cooler core 18, one must balance the flow needs of the filter 32 to adequately remove contaminants with the required heat rejection from the transmission oil cooler 12. The percentage of flow and the size of the cooler depend upon the particular vehicle and transmission, among other factors. For example, the core 18 of the oil cooler assembly 12 can be increased in sized slightly to account for the reduced amount of oil flowing through it, or the cooler assembly 12 may be relocated on the vehicle to improve the air flow through the fins 22. One might, for example, have about ten percent of the oil flow through the filter 32 and the other ninety percent flow through the oil cooler core 18 at operating temperature. Of course the percentage will vary somewhat with oil temperature. The range for the percentage fed through the oil filter 32 may be as little as five percent, or less, and as high as twenty five percent, or more. Again, the percentage depends upon the particular vehicle and transmission and the desired amount of oil filtration and cooling.

Since the transmission oil cooler circuit 11 is usually the lube supply to the transmission, the partial flow filter arrangement (i.e., the oil flow through the filter 32 is in parallel with the oil flow through the heat exchanger core 18) is employed to ensure adequate oil flow through the transmission under all transmission operating conditions. This arrangement causes filtration of only a percentage of the oil that flows through the oil cooler circuit 11, but assures that there is always adequate flow of oil for transmission lubrication, even under cold engine start conditions and filter blind off conditions. Moreover, with the filter 32 placed in parallel with the transmission oil cooler core 18, which is already an existing pressure drop in the transmission oil circuit 10, the result can be a higher total flow (combined core flow plus the filter flow) through the transmission oil cooler circuit 11 due to the overall reduction in the circuit restriction.

In any event, the transmission oil cooler circuit 11 is a pressure regulated circuit downstream of the vehicle's torque converter (not shown), which has consistent, stable flow across most of the engine speed range. Using this circuit minimizes the creation of an additional demand on the oil pump, while still allowing for better filtration of the oil.

Furthermore, the oil filter 32 being outside of the transmission housing makes it ideal for packaging flexibility, as well as having very good accessibility for servicing of the filter 32. The service cover 34 is preferably threaded into the end cap 36, and can then be unscrewed and removed. With the cover 34 off, the filter 32 can be removed and replaced with a clean one, and the service cover 34 screwed back into place.

Figure 2:
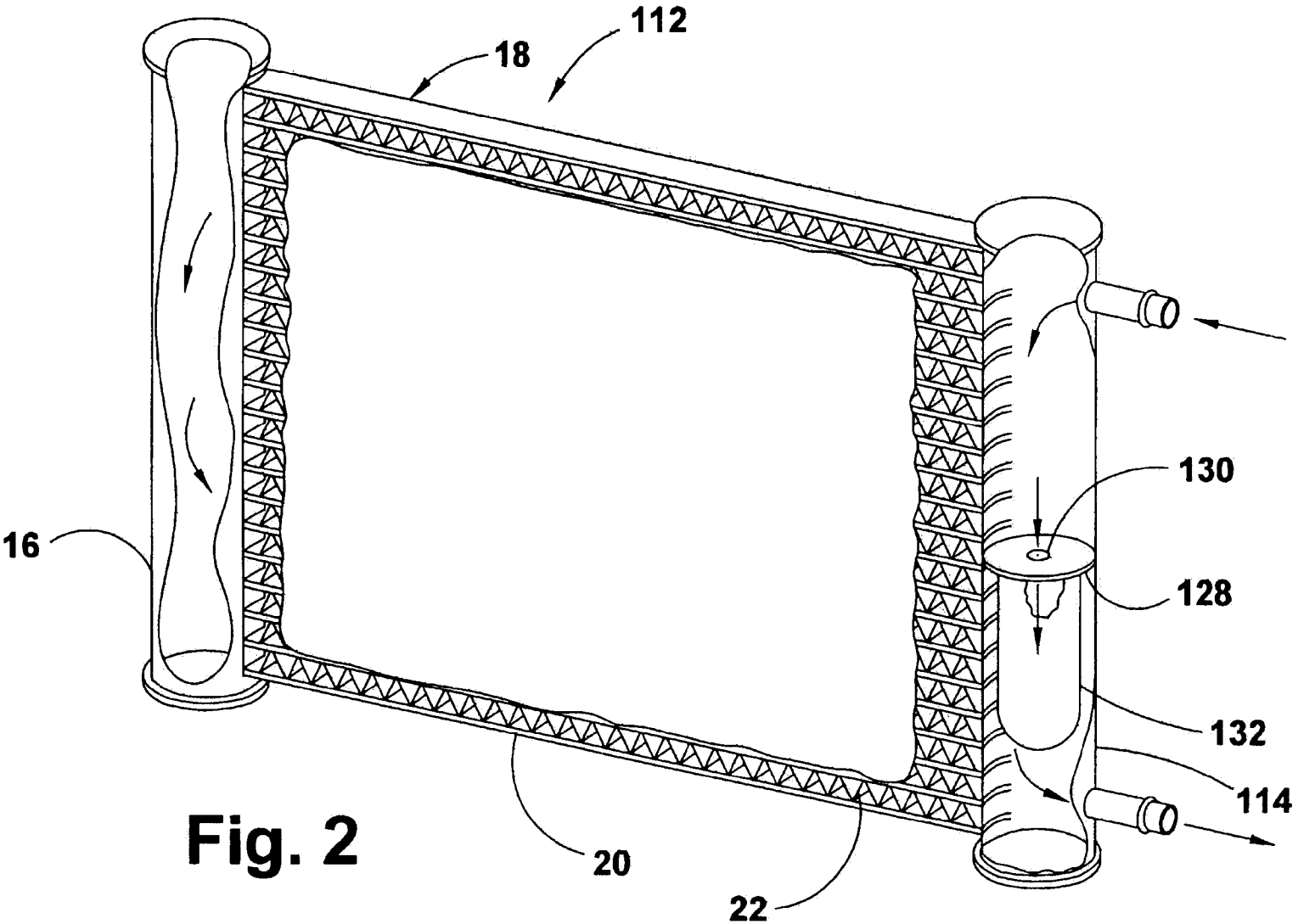
FIG. 2 is a perspective, partial cutaway, view of a transmission oil cooler with a filter similar to FIG. 1, but illustrating an alternate embodiment of the present invention.

A second embodiment of the present invention is illustrated in FIG. 2. In this embodiment, elements that are the same as in the first embodiment will be designated with the same element numbers, but those that have changed or been added will be designated with 100 series numbers. The core 18, including both the fins 22 and ribs 20, and the second end pipe 16 of the oil cooler assembly 112 are the same as in the first embodiment. The first end pipe 114 still includes a dividing plate 128 with a flow control orifice 130, but the filter 132 is now a bag type filter, mounted on the underside of the plate 128. The specific operation of this embodiment is essentially the same as the first embodiment and so will not be discussed further. This embodiment does not show a servicing cover like the first embodiment, but it may also be designed to have one, if so desired.

While certain embodiments of the present invention have been described in detail, those familiar with the art to which this invention relates will recognize various alternative designs and embodiments for practicing the invention as defined by the following claims.

What is claimed is:

1. An oil cooler assembly for use with an automatic transmission system of a vehicle comprising:

a first end pipe including an oil inlet, adapted for receiving oil from the transmission system, an oil outlet, adapted for returning oil to the transmission system, and a dividing plate sealingly mounted in the first end pipe between the oil inlet and the oil outlet, with the dividing plate including a flow control orifice therethrough, and with the dividing plate defining a first portion of the first end pipe located generally between the dividing plate and the oil inlet and a second portion of the first end pipe located generally between the dividing plate and the oil outlet;

a second end pipe spaced from the first end pipe;

a core, located between the first end pipe and the second end pipe, and including a first set of ribs extending from the first portion of the first end pipe to the second end pipe and a second set of ribs extending from the second end pipe to the second portion of the first end pipe; and an oil filter sealingly mounted in the first end pipe about the orifice and adapted to thereby cause oil flowing through the orifice to flow through the filter.

2. The oil cooler of claim 1 wherein the filter is located between the dividing plate and the oil inlet.

3. The oil cooler of claim 2 wherein the filter is generally cylindrical in shape.

4. The oil cooler of claim 1 wherein the filter is located between the dividing plate and the oil outlet.

5. The oil cooler of claim 4 wherein the filter is a bag filter.

6. The oil cooler of claim 1 wherein the first end pipe includes an end cap, and the end cap includes an opening therethrough, and the first end pine includes a service cover sealingly and removably mounted in the opening.

7. The oil cooler of claim 1 wherein the filter is made of paper.

8. The oil cooler of claim 1 wherein the filter is made of fiberglass.

9. The oil cooler of claim 1 wherein the orifice has a size and that size is such that, for oil entering the oil inlet, five to twenty five percent of the oil entering the inlet will flow through the orifice.

10. An oil cooler assembly for use with an automatic transmission system of a vehicle comprising:

a first end pipe including an oil inlet, adapted for receiving oil from the transmission system, an oil outlet, adapted for returning oil to the transmission system, and a dividing plate sealingly mounted in the first end pipe between the oil inlet and the oil outlet, with the dividing plate including a flow control orifice therethrough, and with the dividing plate defining a first portion of the first end pipe located generally between the dividing plate and the oil inlet and a second portion of the first end pipe located generally between the dividing plate and the oil outlet, and with the first end pipe including an end cap, and the end cat, including an opening therethrough, and the first end pipe also including a service cover sealingly and removably mounted in the opening;

a second end pipe spaced from the first end pipe;

a core, located between the first end pipe and the second end pipe, and including a first set of ribs extending from the first portion of the first end pipe to the second end pipe and a second set of ribs extending from the second end pipe to the second portion of the first end pipe; and an oil filter sealingly mounted in the first end pipe about the orifice and adapted to thereby cause oil flowing through the orifice to flow through the filter.

11. The oil cooler of claim 10 wherein the filter is located between the dividing plate and the oil inlet.

12. The oil cooler of claim 10 wherein the filter is made of paper.

13. The oil cooler of claim 10 wherein the filter is made of fiberglass.

* * * * *